US006644612B2

(12) United States Patent
Webb

(10) Patent No.: US 6,644,612 B2
(45) Date of Patent: Nov. 11, 2003

(54) MOUNTING SYSTEM FOR A BEVERAGE CONTAINER

(76) Inventor: James Webb, 3112 Kashiwa St., Torrance, CA (US) 90505-4011

( * ) Notice: Subject to any disclaimer, the term of this patent is extended or adjusted under 35 U.S.C. 154(b) by 0 days.

(21) Appl. No.: 10/201,987

(22) Filed: Jul. 23, 2002

(65) Prior Publication Data

US 2003/0019992 A1 Jan. 30, 2003

Related U.S. Application Data

(60) Provisional application No. 60/307,528, filed on Jul. 24, 2001.

(51) Int. Cl.[7] ..... A47K 1/08
(52) U.S. Cl. ..... 248/311.2
(58) Field of Search ..... 248/311.2, 312.1, 248/312, 106, 105

(56) References Cited

U.S. PATENT DOCUMENTS 2,893,675 A * 7/1959 Smith et al. ..... 248/311.2
2,926,879 A * 3/1960 Dietrich ..... 248/311.2
3,734,439 A * 5/1973 Wintz ..... 248/224.51
4,773,348 A * 9/1988 Rowley ..... 114/219
5,190,257 A * 3/1993 Gradei et al. ..... 248/231.71
5,484,129 A * 1/1996 Megal ..... 248/311.2
6,045,017 A * 4/2000 Connell ..... 224/148.7

* cited by examiner

*Primary Examiner*—Kimberly Wood
*Assistant Examiner*—A. Joseph Wujciak
(74) *Attorney, Agent, or Firm*—Roger A. Marrs

(57) ABSTRACT

A mounting system for a beverage container includes a cup holder having a pair of upright spaced-apart arms forming a yoke terminating in a first pivotal connection with opposite ends of a semi-circular retaining ring. The first pivot further includes connection with the opposite ends of a semi-circular arm having a midsection that includes a thrust bearing pivot attachable to a support hanger. The hangar has a shaped receptacle so as to provide releasable attachment with a pin on the semi-circular arm of the holder and cantilevers the holder outwardly from a supporting surface. The retaining ring is a "flip-over" loop which permits assembly of a container into the holder as well as easy removal therefrom. The first pivot connection includes a bearing pressed into the terminating ends of the yoke arms and is employed to movably mount a stud which includes a central portion for supporting the opposite ends of the retaining loop between the opposite ends of the semi-circular arm and the terminating ends of the yoke for the cup holder.

9 Claims, 3 Drawing Sheets

FIG. 7.
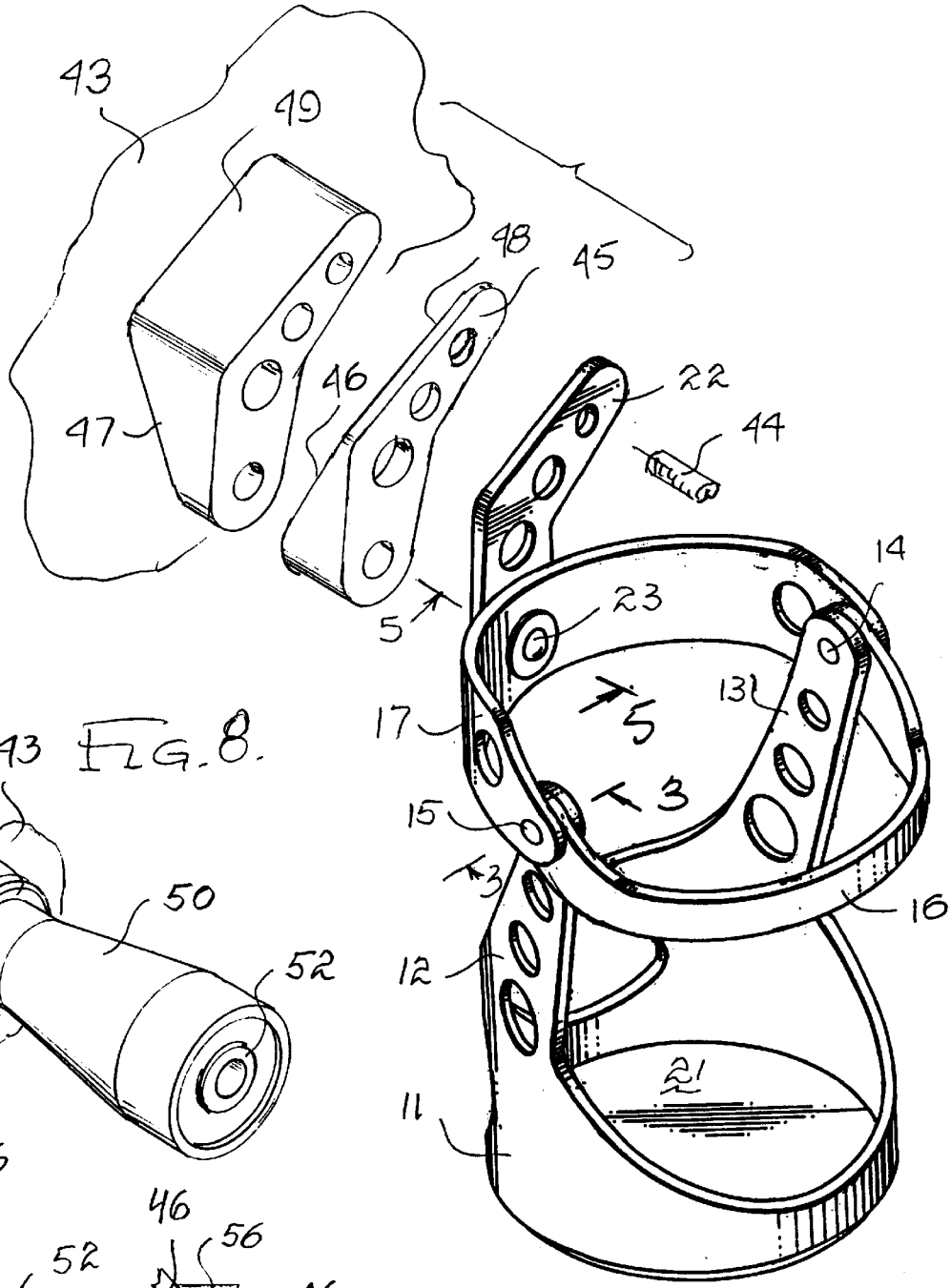
FIG. 8.
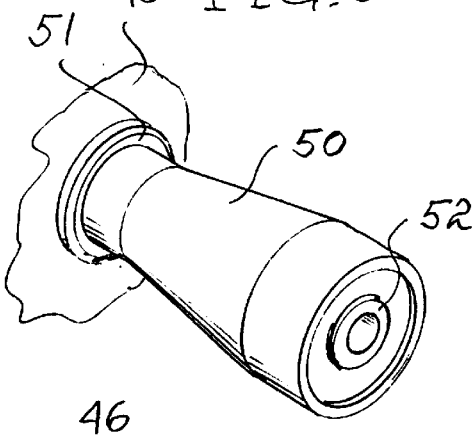
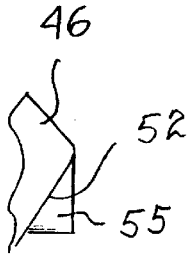
FIG. 9.
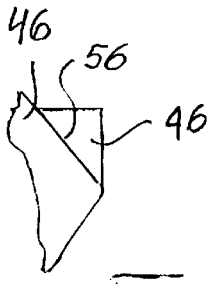
FIG. 10.

MOUNTING SYSTEM FOR A BEVERAGE CONTAINER

Priority claimed based on Ser. No. 60/307,528 filed Jul. 24, 2001.

BACKGROUND OF THE INVENTION

1. Field of the Invention

The present invention relates to the field of accessory holders such as for beverage containers, and more particularly to a novel holder which is fully articulated for universal movement and which is adapted to retain a variety of accessory items regardless of size and usage.

2. Brief Description of the Prior Art

In the past, it has been the conventional practice to support accessory items such as beverage containers or the like employing a simple wire cage construction. The mounting of cage onto a wall surface usually incorporates a single universal joint which supports the weight of the accessory being supported such as a beverage container.

Difficulties and problems have been encountered with such a prior accessory or container holder which stem largely from the fact that the single universal joint does not function properly for articulation of the holder when a weighted objected such as a container full of liquid is supported thereby. Also, the holder itself is limited to a particular size and the mounting is limited to a flat surface and will not accommodate a shaped surface. Also, the mounting for conventional holders does not permit cantilevered mounting of the holder in either an upward or downward orientation and does not provide for spacing the mounting of the holder at a suitable distance from the supporting wall.

Therefore, a long-standing need has existed to provide a mounting system for beverage containers or the like which includes full articulation of the holder from its mounting through the use of separate pivotal bearing mountings in order to achieve universal movement. Also, mounting means should be provided so that the holder for the container may be mounted at a desired distance in a cantilevered fashion outward from the supporting surface as well as having a mounting shaped to accommodate or conform to the shape of the mounting surface.

SUMMARY OF THE INVENTION

Accordingly, the above problems and difficulties are avoided by the present invention which provides a novel mounting system for a beverage container that includes a cup holder having a pair of upright arms terminating in a first pivotal connection with the opposite ends of a semicircular retaining ring. The first pivot means further includes connection with the opposite ends of a semicircular hanger arm having a midsection that includes a thrust bearing pivoting means readily attachable to a support hanger. The hanger may be shaped so as to provide an up or down mounting of the holder and may further include an extension arm that cantilevers the holder outwardly from a supporting surface. The retaining ring may be described as a "flip-over" loop which readily permits assembly of a beverage container into the holder as well as easy removal therefrom. The loop can accommodate or retain a variety of article sizes and configurations. The first pivot means includes a bearing pressed into the terminating ends of the yoke of the cup holder and is employed to movably mount a stud which includes a central portion for supporting the opposite ends of the retaining loop between the opposite ends of the hanger arm and the terminating ends of the yoke for the cup holder. Additionally, the second or mounting pivot means for the hanger arm and the hanger includes a pair of thrust bearings mounted in recesses on opposite sides of the midsection of the hanger arms and further includes a pair of mounting covers for accepting a mounting puck and screw to complete attachment of the midsection of the hanger arm to the hanger.

Therefore, it is among the primary objects of the present invention to provide a novel mounting system for a container which may include a pivotal fully articulated mounting means so that the container will be supported in a variety of orientations as the wall on which it is mounted may move in several directions such as the bulkhead of a boat.

Another object of the present invention it to provide a novel fully articulated mounting system for a beverage container which includes shock absorbing dampers in the pivot means whereby a silicone, viscous fluid embedded into the bearings permits smooth and shock absorbing capabilities.

Yet another object of the present invention is to provide a fully articulated pivoting mounting means which allows an inverse rotary mount of a primary hanger for the container as well as for vertical positioning.

A further object resides in providing a gyro mounting system for holding a variety of accessories such as beverage containers or the like that permits a "squeeze" release for the container that allows other components such as pads, eyeglass holders or the like to be mounted thereon.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

FIG. 7 is an exploded perspective view illustrating a variety of hangers for supporting the container holder;

FIG. 8 is a perspective view of an extension for mounting the hanger and beverage container holder outwardly from a supporting surface;

FIGS. 9 and 10 are diagrammatic views showing different shaped supporting wall surfaces to which the hangers shown in FIG. 7 can be adapted.

DESCRIPTION OF THE PREFERRED EMBODIMENT

Figure 1:
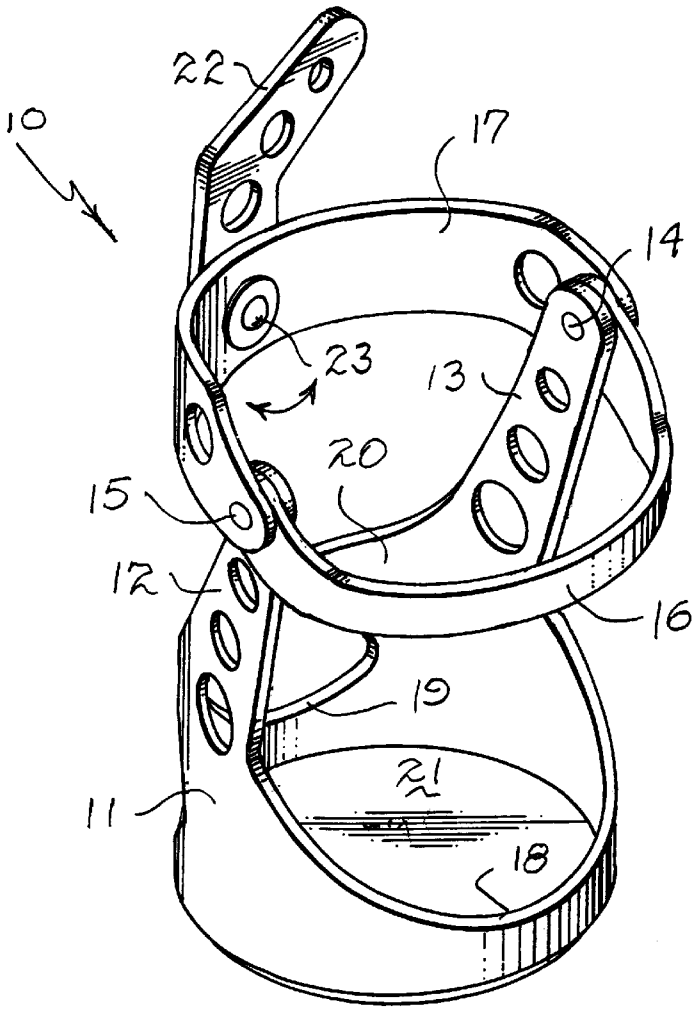
FIG. 1 is a front perspective view of the novel mounting system for a beverage container incorporating the present invention.

Referring to FIG. 1, the inventive mounting assembly for a beverage container or the like is illustrated in the general direction of arrow 10 which includes a container holder 11 that has a pair of yoke members 12 and 13 which extend upwardly to terminate in pivot connections 14 and 15 in fixed spaced-apart relationship. The pivot connections also support the opposite ends of a frontal loop 16 which is semicircular while also supporting a rear semi-circular loop or hanger arm 17. The front loop may be referred to as a retaining ring and is employed in connection with a frontal lip 18 for supporting a beverage can, container or the like in a cavity. The cavity is further defined by the inside and opposing spaced-apart surfaces of the yokes 12 and 13 as well as by a rear member 20. The bottom 21 serves to support the container in the storage cavity while the retaining loop 16 supports the upper end of the container while the frontal lip 18 supports the front of the container. The back lip 19 supports the back of the container at its lower end while the hanger arm 17 supports the upper portion of the container when it is on arm 17.

It can also be seen that a hanger 22 is pivotally attached at one of its ends to the midsection of the hanger arm by a pivot 23. Therefore, it can be seen that the carrier can pivot about a horizontal axis passing through the pivot 23 while the cup holder 11 can pivot about the axis defined by pivot 14 and 15. Therefore, a further articulation of the cup holder is provided as well as proper retention of the container in the holder. A plurality of openings is provided in the hanger 22, hanger arm 17 and the yoke members 12 and 13 which serve as lightening holes cold so as to conserve material as well as to lighten the overall construction.

Figure 2:
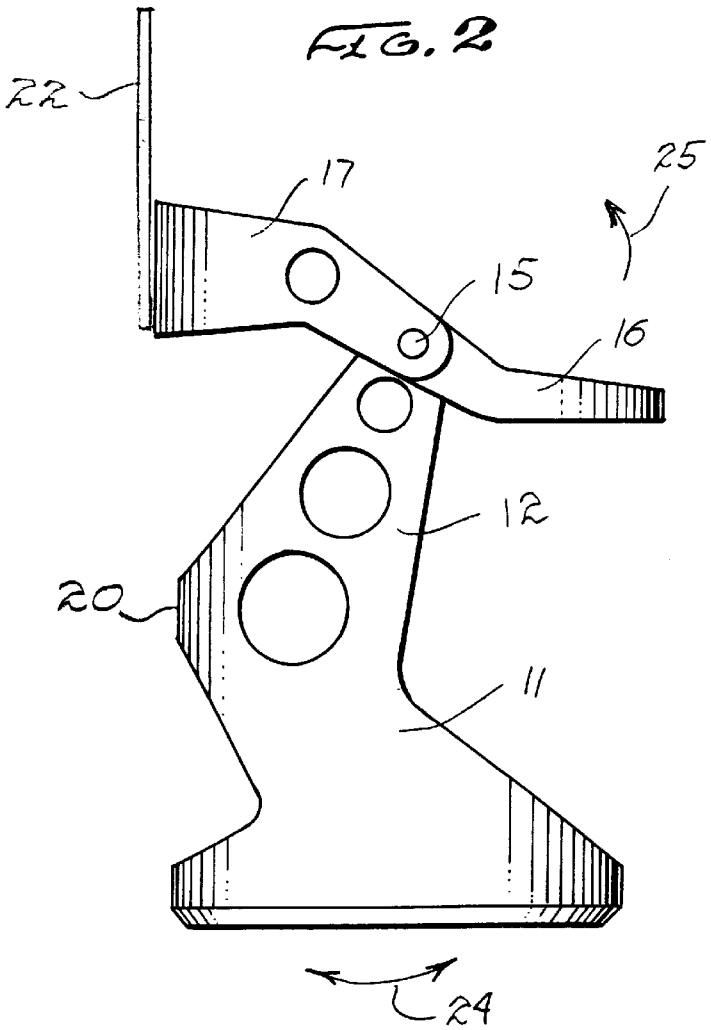
FIG. 2 is a side elevational view of the mounting system shown in FIG. 1.

In FIG. 2, it can be seen that the cup holder may rock fore and aft in the direction of arrow 34 while retaining loop 16 may be pivoted to an upward position as shown by arrow 25 when it is desired to remove the container from the holder. However, it is also possible to remove the container through the enlarged opening in the storage cavity defined by the semicircular inner arm 17 and the semicircular retaining ring 16.

Figure 3:
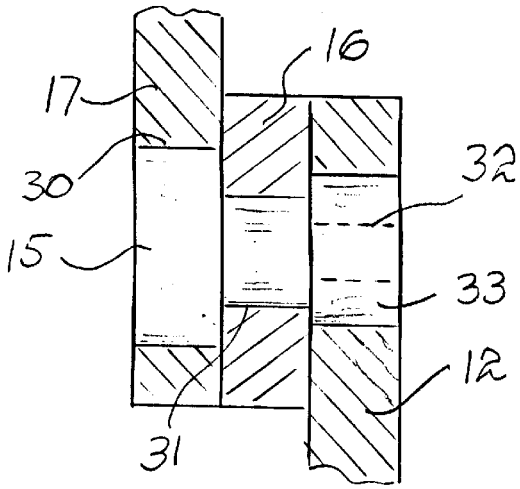
FIG. 3 is an enlarged transverse cross-sectional view of the first mounting pivoting means used in the mounting system as taken in the direction of arrows 3—3 of FIG. 7.
Figure 4:
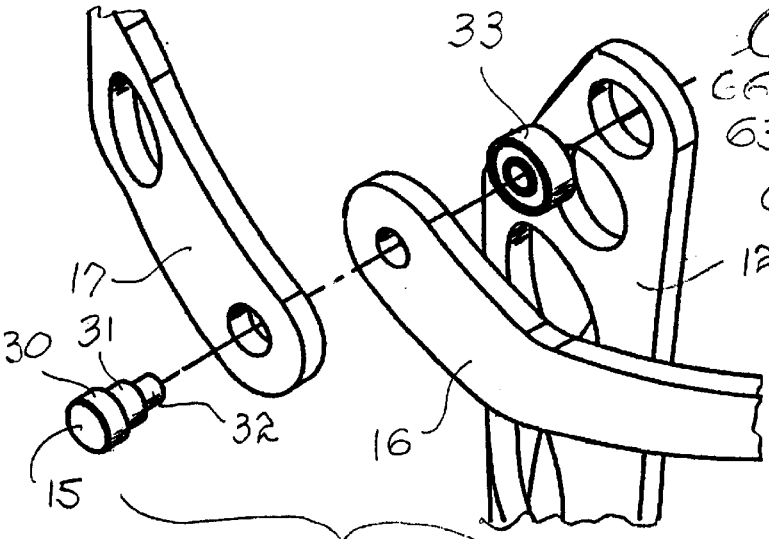
FIG. 4 is a perspective exploded view of the first pivoting means used in the mounting system.

Referring now in detail to FIGS. 3 and 4, it can be seen that the pivot 15 includes a pivot having three shoulders of different diameters. The first shoulder is indicated by numeral 30 and is adapted to fit into a hanger arm bore in the end of inner arm 17 by means of a press fit. The second shoulder is indicated by numeral 31 and fits into a retaining ring bore of retaining ring or loop 16. 31 indicates the shoulder and a smaller diameter shoulder 32 serves as a mounting for a bearing 33 which occupies a bore in the cup holder yoke arm 12. The bearing is press fitted into the bore of the yoke 12.

Figure 5:
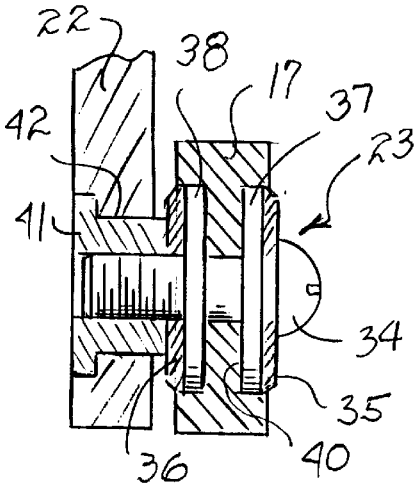
FIG. 5 is an enlarged transverse cross-sectional view of the second pivotal mounting means as taken in the direction of arrows 5—5 of FIG. 7.
Figure 6:
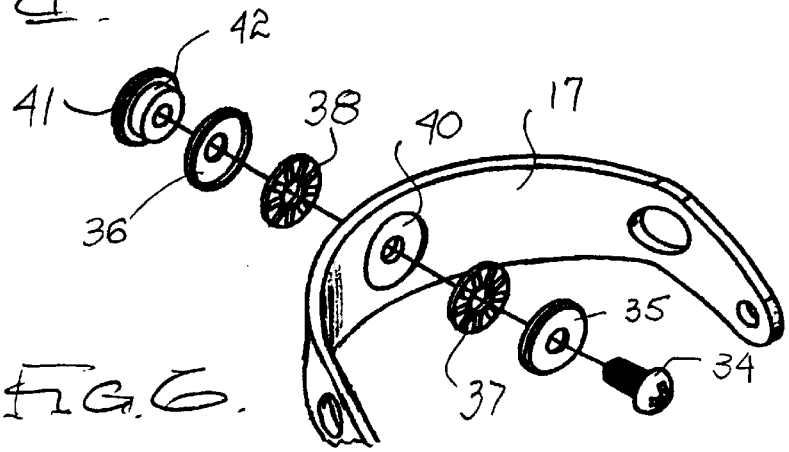
FIG. 6 is an exploded view, in perspective, of the second pivotal mounting means.

Referring now in detail to FIGS. 5 and 6, the pivot 23 is illustrated as having a fastener or retainer 34 which projects through bearing covers 35 and 36 as well as thrust bearings 37 and 38 respectively. Preferably, the thrust bearings 37 and 38 are mounted within recesses such as recess 40 in connection with thrust bearing 37. To complete the pivot, the threaded shank of the retainer 34 is in threaded engagement with the bore of a mounting puck 41. The puck 41 includes a shoulder 42 which is press fitted into a bore in the hanger 22.

Referring now in detail to FIG. 7, it can be seen that the mounting means further includes shaped and angled spacers that may readily attach the full articulated container holder onto a wall, bulkhead or the like, as indicated by numeral 43. It is envisioned that the hanger 22 may be directly attached to the surface of the wall or bulkhead 43 by means of a suitable fastener 44. The back side of hanger 22 is flat and therefore is adapted to bear against a flat wall surface 43. However, if the wall surface is angular or specially shaped, a spacer such as spacer 45 may be employed which is angled at its front or rear surface, preferably the rear surface, as indicated by numeral 46, so that gravity will cause the articulated cup holder to hang in a proper position such as would occur with a pendulum. Also, a spacer such as indicated by numeral 49 may be employed in order to provide a thicker spacer and which will provide a flat surface on one side and an angular surface on the opposite side, such as indicated by numeral 47. It can also be determined that the spacer 45 may include an upwardly projecting arm 48 to which the hanger 22 can be attached or the spacer can be reversed so that the arm 45 downwardly depends and the hanger can be attached thereto. The same options are available with respect to spacer 49.

Referring now in detail to FIG. 8, an elongated extension 50 may be employed whereby one end 51 is readily attached to the surface of the wall or bulkhead 43 while the opposite end can receive attachment either directly by means of pivot 23 or hanger 22 may be directly attached to the end 52 of the extension 50.

In FIG. 9, a wall 46 is illustrated as having an angular surface 52 and the hanger 55 may be used to support the cupholder therefrom. However, a different angle for wall 46 is shown in FIG. 10 and the angle is indicated by numeral 56 from which the spacer 46 may be mounted in order to provide a frontal flat surface against which the hanger 22 can be attached so that the container will downwardly depend in proper orientation.

Figure 11:
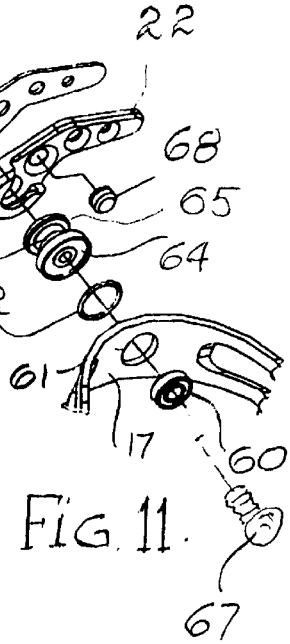
FIG. 11 is an exploded perspective view of a hanger arrangement for detachably mounting a holder for supporting a container.

Referring to FIG. 11, a detachable mount is illustrated for coupling the semi-circular hanger arm 17 to the hanger 22. Bearing 60 is inserted and mounted in opening 61 with a seal 62 pressed against the bearing. A fitting 63 includes a cup 64 in which the seal partially sets while a flanged member 65 is carried on the opposite end of the fitting.

The hanger 22 includes an open receptacle 66 for insertably receiving and detachably connecting with the flanged member 65. The receptacle includes a groove intended to mate with and receive the flanged member. A fastener 67 secures the mount assembly together. A friction pad 68 bears against the fitting 63, or in some cases, against the back of arm 17 to hold the mount in place. A gasket 70 is employed as a backing between the hanger 22 and the bulkhead wall or supporting surface.

In view of the foregoing, it can be seen that the mounting system for a container is illustrated in the FIGURES which provides a restraint system for the container. The container may easily be inserted into or withdrawn from the cup holder 11. The retaining loops provide a tension retainer for holding the container in the holder 11 and a sort of gyro system is provided whereby a "squeeze" release can be employed for releasing the container from the holder. Also, other components, such as pads, eyeglass holders, etc., or the like, may be mounted on the holder with minor configuration changes. Shock absorbing features are provided since silicone, viscous fluid embedded in the bearings, serves as a damper and provides an axis of movement or rotation. The mounting allows an inverse rotary mount of the primary hanger for vertical positioning. A flip-over loop 17 serves as a secondary closing loop in order to retain a variety of sizes and configurations of containers. The specially shaped spacers can mount the hanger and the container holder on flush or angled surfaced walls or bulkheads and the holder is maintained in a cantilevered mounting outwardly from the surface of the wall in a position for full rotation and articulation regardless of the shape or angle of the wall surface.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A mounting for a container comprising:

a container holder having a bottom with a pair of spaced-apart arms defining a yoke;

a semi-circular support member terminating in ends pivotally joined with said pair of spaced-apart arms;

said semi-circular support member having a midsection separating said terminating ends;

a hanger member disposed on said midsection of said semi-circular arm;

said container holder includes a rear member extending between said pair of spaced-apart arms cooperating with said bottom to removably support a container;

a semi-circular retaining member having opposite ends jointed with said terminating ends and said ends of said pair of spaced-apart support arms;

pivot connections coupling said pair of spaced-apart arms with said ends of said semi-circular support member permitting said container holder to swing back and forth in accordance with gravitational force; and each pivot connection includes a bearing mounted in each arm of said pair of spaced-apart arms and a pivot having a first shoulder press fitted with said semi-circular support member, a second shoulder for rotatably supporting said retaining member and a stud for carrying said bearing and said pair of spaced-apart arms.

2. The mounting defined in claim 1 wherein:

each bearing includes a shock absorbing feature having a silicone, viscous fluid embedded therein, serving as a damper while providing an axis of rotational movement.

3. The mounting defined in claim 2 including:

a pivot connection rotatably coupling said semi-circular retaining member with said hanger member having a pivotal axis normal to a pivotal axis of said bearing in each arm of said spaced-apart arms.

4. The mounting defined in claim 3 wherein:

said pivot connection includes a grooved receptacle carried on said hanger member and a flanged fitting carried on said midsection adapted to insertably engage with said grooved receptacle.

5. The mounting device for a container comprising:

a container holder having a storage cavity defined between a pair of upright support members terminating in spaced-apart free ends and connected together at a common bottom;

a first semi-circular member having spaced-apart terminating end portions integrally connected together by a midsection;

a second semi-circular member having end portions pivotally coupled to said free ends and to said end portions so as to provide a pivot joint allowing relative movement between said holder and said second semi-circular member with respect to said first semi-circular member; and a hanger member detachably connectable to said midsection by a pivot means permitting rotation of said first semi-circular member about an axis normal to an axis of rotation established by said pivot joint.

6. The mounting device defined in claim 5 including:

a rigid rear brace member connected between said upright support members in spaced-apart relationship with respect to said common bottom.

7. The mounting device defined in claim 6 including:

shock absorbing bearings included in each of said pivot joints.

8. The mounting device defined in claim 7 including:

a bearing assembly included in said pivotal connection between said first semi-circular member and said hanger member.

9. The mounting device defined in claim 8 including:

a grooved receptacle provided on a selected end of said hanger member; and a fitting carried on said midsection having a flanged edge insertably registerable and engageable with said grooved receptacle and adapted to permit rotational movement of said first semi-circular member with respect to said hanger member.

* * * * *